United States Patent [19]

Vinton

[11] 3,938,669

[45] Feb. 17, 1976

[54] HYDRAULIC CIRCUIT FOR A PIPELAYER

[75] Inventor: David S. Vinton, Morton, Ill.

[73] Assignee: Caterpillar Tractor Co., Peoria, Ill.

[22] Filed: Mar. 25, 1974

[21] Appl. No.: 454,107

[52] U.S. Cl. ..... 212/8 B; 214/142

[51] Int. Cl.[2] ..... B66C 23/00

[58] Field of Search ..... 214/142, 130 R, 762; 60/484, 486; 91/411, 413; 212/8 B, 35

[56] References Cited

UNITED STATES PATENTS

| | | | |
|---|---|---|---|
| 3,265,218 | 8/1966 | Stefanutti | 212/35 R X |
| 3,300,060 | 1/1967 | Lado | 212/55 |
| 3,542,228 | 11/1970 | Horsch | 214/762 |
| 3,606,049 | 9/1971 | Gordon | 214/762 |
| 3,614,273 | 10/1971 | Wallace | 214/762 X |
| 3,641,876 | 2/1972 | Wienke | 91/413 X |
| 3,747,472 | 7/1973 | Knutson | 91/413 X |

FOREIGN PATENTS OR APPLICATIONS

| | | | |
|---|---|---|---|
| 622,564 | 9/1962 | Belgium | 214/142 |
| 360,458 | 11/1931 | United Kingdom | 60/486 |

*Primary Examiner*—Philip Goodman
*Assistant Examiner*—Michael J. Forman
*Attorney, Agent, or Firm*—Phillips, Moore, Weissenberger Lempio & Strabala

[57] ABSTRACT

A pipelayer comprising a tractor vehicle having an extensible boom pivotally mounted to the vehicle and extended to one side thereof is provided with a hydraulic circuit for performing all operations of the boom and accessories. The hydraulic circuitry comprises a low volume source of fluid selectively directable to a first plurality of the motors of the machine for operating these motors at a low speed and a second source of fluid including circuits for selectively directing the fluid to a second plurality of motors including some of the first motors. Two motors within the circuit may be operated from either of the sources of fluid. Valve means are interconnected for simultaneous control for selectively directing fluid from either of the sources to the two motors.

20 Claims, 2 Drawing Figures

ROTARY VALVE
TO HOIST LINKAGE
PILOT SIGNAL
LINEAR VALVE
TO BOOM LINKAGE
PILOT SIGNAL
N
L'
L
R
R'

HYDRAULIC CIRCUIT FOR A PIPELAYER

BACKGROUND OF THE INVENTION

The present invention relates to hydraulic circuits and pertains particularly to a hydraulic circuit for a pipelayer to provide all hydraulic functions for the pipelayer.

Pipelayers in the past have typically been constructed with mechanical winches and cables for controlling positioning the boom and hoisting a load. This machine typically has the usual problems associated with the use of cables, clutches and brakes to control the various functions of the machine and its attachments. Cables are quite hazardous and are subject to rapid wear and breakage. The control of the boom and load by means of cable and clutches presents problems of both control and movement of the boom and its load.

The use of hydraulic systems to control and perform these functions has started to come into use recently. However, some of these systems have disadvantages in that they do not provide the necessary precise control and do not have the versatility desired.

The use of hydraulically actuated booms and hoist assemblies is illustrated in U.S. Pat. Nos. 3,265,218 issued Aug. 9, 1966, to Stefanutti; and 3,300,060 issued Jan. 24, 1967, to Lado.

SUMMARY AND OBJECTS OF THE INVENTION

In accordance with the present invention, the hydraulic circuit is provided for a pipelayer wherein the circuit includes two separate sources of fluid for controlling functions of the machine. One source of fluid is a low volume source for precise manipulation and control of the implements as well as to operate an anti-drift mechanism for the boom and hoist. The second source is a high volume source to provide high speed operation of the various functions. The control valves for both systems for controlling the hoist and the boom motors are operated from the same control lever for the sequential operation of the valves for the separate circuits.

It is the primary object of the present invention to overcome the aforementioned problems of the prior art.

It is another object of the present invention to provide a hydraulic system for a pipelaying mechanism which provides both high speed and low speed operation of the pipelaying mechanism.

A further object of the present invention is to provide a hydraulic control system for pipelaying machine wherein the control system includes both high speed and low speed operation as well as anti-drift mechanisms.

Another object of the present invention is to provide a hydraulic circuit for pipelayers wherein the circuit having both high speed and low speed operations includes anti-drift means as well as emergency drop control means.

BRIEF DESCRIPTION OF THE DRAWINGS

The above and other objects and advantages of the present invention will become apparent from the following description when read in conjunction with the accompanying drawings wherein.

DETAILED DESCRIPTION OF PREFERRED EMBODIMENT

Figure 1:
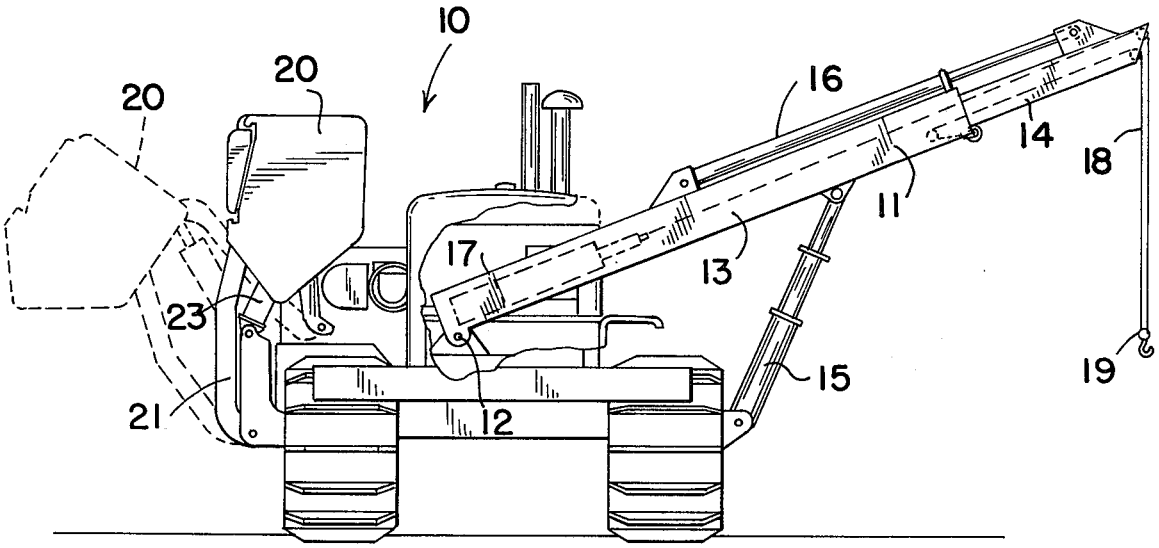
FIG. 1 is an end elevational view of a pipelaying vehicle embodying the present invention.

Referring now to the drawings and particularly to FIG. 1, there is illustrated a pipelayer vehicle incorporating the present invention. The pipelayer comprises generally a suitable vehicle generally designated by numeral 10 which will be any suitable type, but as illustrated, preferably a crawler tractor. An extensible boom 11 is pivotally mounted on the vehicle preferably near the center thereof for pivotal movement in a vertical plane about a horizontal axis such as the pin 12 on the vehicle. The boom 11 generally comprises a first section 13 which is pivoted at the pivot point 12 and a second outer section 14 which is telescopically received within the first portion 13 and extensible therefrom.

The boom is raised and lowered within this plane about pivot point 12 by means of a suitable hydraulic motor or ram 15 shown secured at one end to the frame means of vehicle 10 and at the other end to boom 11. A boom extension motor 16 which is also a suitable hydraulic motor is connected at one end to section 13 and the other end to section 14 of the boom 11 and is operative to extend and retract the boom sections.

A hoist motor 17 is mounted within boom section 13 and is connected at one end to the boom section 13 and at the other to a cable 18 which is suitably mounted for extension and retraction from the end of the boom by means of suitable pulleys and the like. A hook 19 or other suitable implement means may be mounted on the outer end of the cable 18.

A suitable counterweight 20 is pivotally mounted on the opposite side of the tractor forming the extension of the boom 11 for counterbalancing the weight of the load on the boom. The counterweight is suitably mounted on the tractor by means of linkage system for extension outward into the position as shown in phantom. The counterweight is pivotally supported on a pair of links 21 and 22 which are pivoted at one end to the tractor and the other end to the counterweight itself. A counterweight extension motor 23 is connected between the vehicle frame and the counterweight and is operative to extend and retract the counterweight 20 into suitable position to counterbalance the load on boom 11.

Figure 2:
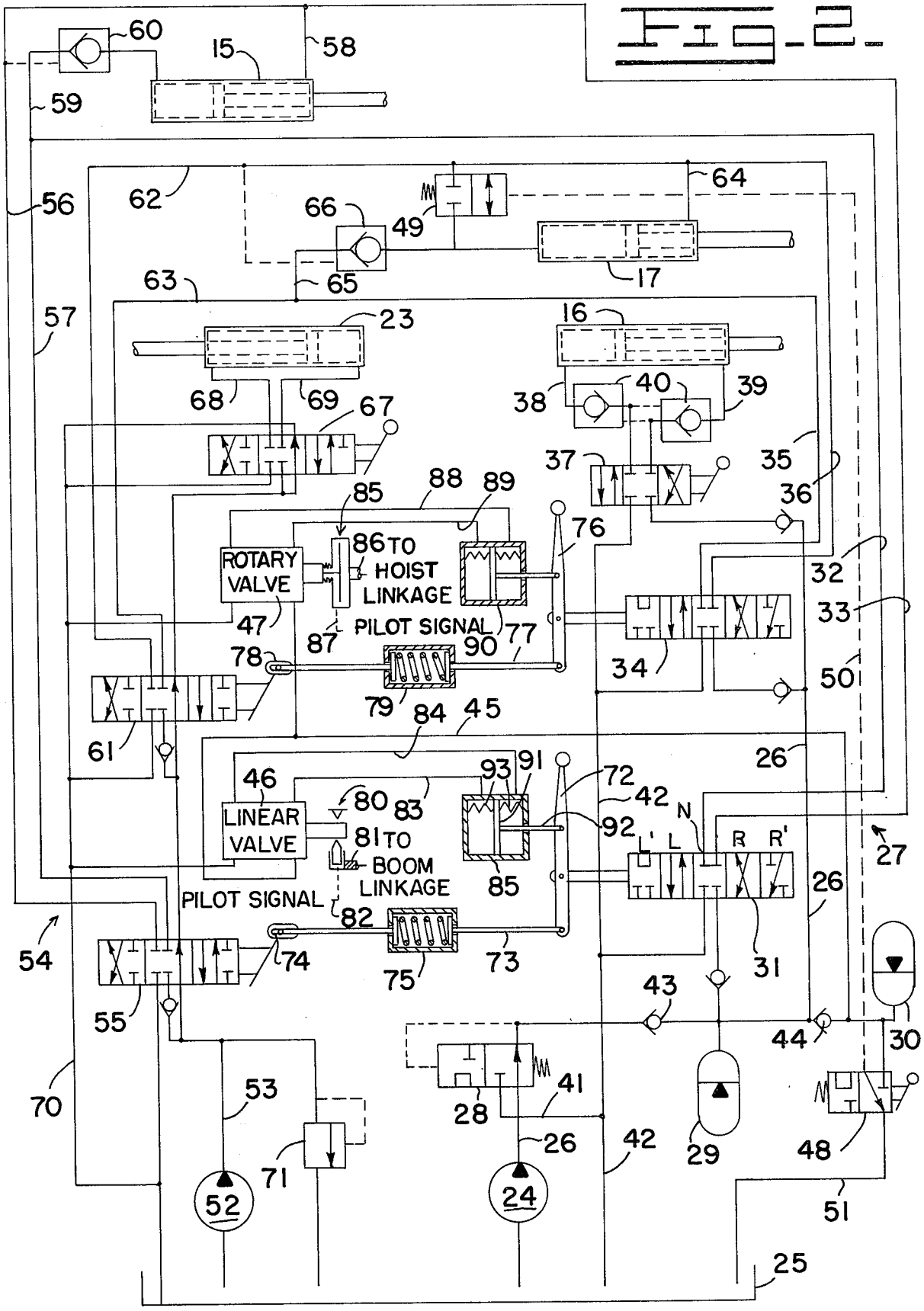
FIG. 2 is a schematic layout of a hydraulic control system embodying the present invention.

Referring now to FIG. 2, there is illustrated in schematic form the preferred embodiment of a hydraulic circuit for the apparatus of FIG. 1. This hydraulic circuit comprises essentially a dual source of hydraulic fluid, one source for low speed operation and precise control, and a second source for high speed operation. The source of pressurized fluid for low speed operation may have a volume on the order of approximately one-fourth that of the high speed source. Separate valve systems are provided for controlling the fluid from the respective sources to the respective motors. The hoist motor and the boom lift motor can be operated selectively from either source. The separate valve systems are interconnected by control means that is operated to shift the low speed valve to operative position first, and thereafter with continued movement of the control means to shift the low speed system into non-operative position while simultaneously therewith shifting the high speed system into operation.

The low volume circuit comprises a source of pressurized fluid which comprises a pump 24 which draws fluid from a reservoir 25 and supplies it by way of supply conduit 26 to a first bank of control valves generally indicated at 27. A charging valve 28 is disposed in the main pressure supply line 24 for maintaining a sufficient pressure therein to charge a pair of accumulators 29 and 30 to which the pump 24 is communicated by way of supply conduit 26. These accumulators maintain a ready supply of fluid for the antidrift control and for an emergency drop system to be described later. The valve 28 may be any suitable spool type dump valve responsive to a predetermined pressure within the main supply line 26 to shift to a position to dump the fluid from supply line 26 to tank 25 via return lines 41 and 42.

A first valve 31 in the bank 27 receives fluid from pump 24 and supplies it by way of conduits or supply conduit 32 and 33 to the boom lift motor 15. The valve 31 is a five-position valve having a closed center neutral position and fluid direction positions immediately to either side of the center position with the outermost position in either direction being a non-directing position of the valve. The function of the latter position would be described later in conjunction with the simultaneous operation of another valve.

A second five-position valve 34 is operative to direct fluid from pump 24 by way of motor supply lines 35 and 36 to the hoist motor 17. This valve is identical to valve 31 and also operates in conjunction with another valve to be described later. A three-position valve 37 is operative to direct fluid from pump 24 by way of motor control lines 38 and 39 to the boom extension motor 16. A load check valve 40 is provided in each of the motor control lines 38 and 39.

The just described circuit is a low speed circuit for the apparatus for the purpose of slowly moving the boom or hoist into a position. This circuit comes into operation first when the control lever for either one of the hoist or the boom lift is activated as will be more fully described later.

The accumulator 29 is operative to maintain a reserve of pressurized fluid in the system for supplying to either one of valves 31, 34 or 37 for incremental movement of the respective motors controlled thereby. The valve 28 is operative in the position shown to direct fluid along the conduit 26 for supply to the respective valves 31, 34 and 37 and to the accumulators 29 and 30. When the valves 31, 34 and 37 are in their neutral position as shown wherein the fluid flow therethrough is stopped, fluid backs up into accumulators 29 and 30 until they are full or reach their maximum pressure at which time valve 28 is shifted automatically by the pilot signal to its rightmost position to communicate the output from pump 24 by way of conduit 41 to the return passageway or conduit 42 back to tank or sump 25. A check valve 43 prevents fluid from accumulators from draining back to sump or back to the pump if the pump should fail or stop. Another check valve 44 is operative to prevent fluid from accumulator 30 from feeding back into the supply line 26.

The accumulator 30 is operative to supply fluid along conduit 45 to supply the fluid to a boom drift sensing valve 46 and a hoist drift sensing valve 47. The complete function of these valves will be more fully described later.

The accumulator 30 also provides fluid which is controllable by means of a valve 48 which controls a pilot operated valve 49 which functions as an emergency drop valve. The normal position of valve 48 as shown vents a pilot line 50 which communicates with valve 49 to tank 25 by way of return line 51. In this position, of valve 48, the control chamber of valve 49 is vented thus permitting valve 49 to shift to its block position as shown to permit normal operation of motor 17. However, upon shifting of valve 48 to its righthand position, fluid from accumulator 30 is communicated by way of the valve through pilot line 50 which biases valve 49 to the left to provide open communication between motor control lines 35 and 36 to permit hoist motor 17 to free wheel or run freely in its response to a load.

The high speed portion of the circuit comprises a high volume pump 52 operative to draw fluid from reservoir 25 and supply it by way of a high pressure supply line 53 to a bank of valves generally indicated by the numeral 54 and comprising a first three-position open-centered valve 55 operative to selectively direct fluid by way of either one of motor control lines 56 or 57 to boom lift motor 15. The motor control line 56 joins with motor lines 33 and passage 58 to supply fluid to the rod end of motor 15. Motor control line 57 joins with motor control line 32 at passage 59 to supply fluid by way of branch passage 59 and a load check valve 60 to the head end of motor 15. A second open-centered control valve 61 in bank 54 is supplied fluid from pump 52 and is operative to direct that fluid by way of motor control lines 62 and 63 to the hoist motor 17. The motor control line 62 joins with motor control line 36 at passage 64 for directing the fluid to the rod end of motor 17. The motor control line 63 joins with the motor control line 35 from the other bank of valves and at passage 65 for directing the fluid to the head end of motor 17. A load check valve 66 is disposed within passage 65 for controlling the fluid within the head end of motor 17.

The load check valves 60 and 66 are of generally conventional design and include appropriate pilot control from the opposite motor control port as shown in dotted line.

A third open center three-position valve 67 is operative to direct fluid from pump 52 by way of motor control lines 68 and 69 to the rod end and head end, respectively, of counterweight positioning motor 23. Each of the respective valves 55, 61 and 67 include an exhaust passage in communication with a return line 70 for returning fluid to reservoir 25. A high pressure relief valve 71 protects the circuit against overpressurization.

Valves 31 and 55 are interconnected by suitable control means to function at least partially simultaneously. The control means comprises a suitable actuating means such as a lever 72 connected directly to valve 31 for positive actuation thereof and interconnected by means of suitable lost motion linkage 73 including a lost motion slot at 74 and including a resilient portion 75 in the link 73.

The valve 31 has five positions designated respectively as the neutral position being the position shown designated by the N; a raise position designated by R; a second raise position designated by R′ permitting raising of the boom by means of the other circuit. A lower position designated by the letter L lowers the boom by means of the low volume circuit, and a second lower position L′ permits lowering by means of the high volume circuit. Thus, with this arrangement and the control interconnection, manipulation of control lever 72 such as to the R position, the lost motion portion of linkage 73 takes up the slack without movement of valve 55, thus permitting only the fluid from pump 24 to be supplied to motor 15 for raising the boom. Upon movement of the lever 72 to the next position R′, motor line 33 is communicated with return line 42, and supply line 26 from pump 24 is blocked. Simultaneously with this movement to the R′ position, linkage 73 moves valve 55 to the left to the raise position of that valve thus supplying fluid from the pump 52 directly to motor 15 for raising the boom in a rapid movement. The linkages and valves operate in a similar manner when valve lever control 72 is moved in a leftward direction for the lowering function.

Valve 34 being identical to valve 31 will function in substantially the same manner in that the linkage interconnecting valve 34 and valve 61 is substantially identical to that connecting the valves 31 and 55. Therefore, similar operation would result. The valves 34 and 61 are interconnected by similar control means including a control lever 76 connected positively or directly to valve 34 and linkage means 77 including lost motion means 78 and a resilient portion 79 interconnecting the lever 76 with valve 61. The terms lost motion means and lost motion connecting means is used herein in its usual sense as used in mechanical linkages to mean a connection which permits an actuating or driving member to move over a predetermined range of movement prior to movement of the actuated or driven member.

The anti-drift control means includes the valve 46 which is suitably positioned to be selectively connected by means of suitable gripping means 80 to a linkage member 81 which is connected directly to the boom linkage. A pilot signal indicated at 82 is operative to actuate the clamping means 80 for connecting the valve 46 to the boom linkage. Once the boom is set in a predetermined position, the clamping means 80 is activated, thus, at that position, valve 46 is in the neutral position. Upon movement of the boom or drifting of the boom from that neutral position, the boom moves valve 46 to one of two positions directing fluid from line 45 by way of one or the other of lines 83 and 84 to an actuator 85 which is operative to move lever 72 for shifting valve 31 to thereby direct fluid to the appropriate end of motor 15 for correcting the drift. Upon movement of the boom back to its initial position, it simultaneously shifts valve 46 to the neutral position, thus permitting valve 31 to shift back to the neutral position. Thus, valve 46 and the clamping means 80, 81 can be considered drift sensor or sensing means.

A similar anti-drift mechanism is provided for the hoist linkage. This anti-drift means includes a valve 47 which is suitably connected by means of a clutch 85 to a shaft 86 of the hoist linkage. The valve 47 and its associated connecting means becomes drift sensor or sensing means for the hoist linkage. The clutch 85 is actuated such as by means of a pilot signal indicated at 87. The valve 47 is indicated as a rotary valve and upon rotation from its neutral position in either direction, is operative to direct fluid from line 45 by way of either one of lines 88 or 89 to an actuator 90 connected to actuate control lever 76. The shaft 86 is preferably connected to a pulley or the like on the boom over which the hoist cable is operated. The operation of this anti-drift mechanism is similar to that of the previously discussed anti-drift mechanism. Upon positioning the hoist in a preferred position, the clutch 85 is actuated, thus connecting valve 47 to a pulley of the hoist linkage. Upon movement of the hoist linkage from that position, rotary valve 47 is rotated from its neutral position, thus directing fluid along either one of lines 88 or 89 to the actuator 90. The actuators 85 and 90 are, as illustrated, double acting pistons disposed in a cylinder with chambers on either side and being normally biased in a central position by spring means as indicated.

The actuator 85, for example, comprises a housing having a cylindrical chamber in which is disposed a double acting piston 91 which is connected by rod 92 to the control lever 72. A pair of springs 93 disposed on each side of the piston 91 biases the piston to a central position within the chamber.

While the present invention has been described and illustrated by means of a specific embodiment, it is to be understood that numerous changes and modifications may be made therein without departing from the spirit and scope of the invention as defined in the appended claims.

I claim:

1. A hydraulic circuit for a pipelayer machine having an extensible boom pivotally mounted to a vehicle, an extensible hoist cable extending from the outer end of said boom, and a counterweight extending from one side of said vehicle to counterbalance said boom, said circuit comprising:

a boom lift motor operatively connected for lifting said boom;

a hoist motor operatively connected for extending and retracting said hoist cable;

a first source of pressurized fluid for supplying fluid by way of first circuit means for low speed operation of said motors;

first valve means for selectively communicating fluid from said first source of fluid to one of said motors;

a second source of pressurized fluid for supplying fluid by way of second circuit means for high speed operation of said motors;

second valve means for selectively communicating fluid from said second source to said one of said motors;

control means interconnecting said first and second valve means and operative over a first range of movement for moving said first valve means into communicating position and operative over a second range of movement for moving said first valve means to a non-communicating position and simultaneously therewith move said second valve means to a communicating position.

2. The hydraulic circuit of claim 1 wherein said one motor is said boom lift motor.

3. The hydraulic circuit of claim 2 comprising boom drift sensing means responsive to a change in the position of said boom from a pre-set position to activate valve actuator means for shifting said first valve means for returning said boom to said pre-set position.

4. The hydraulic circuit of claim 3 wherein said drift sensing means in a valve selectively connectible to said boom to be actuated thereby.

5. The hydraulic circuit of claim 4 comprising accumulator means for accumulating fluid pressure for operating said boom lift motor when said drift sensing means is operative.

6. The hydraulic circuit of claim 3 comprising accumulator means for accumulating fluid pressure for supplying fluid for said valve actuator means when said drift sensing means is operative.

7. The hydraulic circuit of claim 6 wherein said control means interconnecting said first and second valve means includes lost motion means connecting for said control means to said second valve.

8. The hydraulic circuit of claim 1 comprising third and fourth valve means for respectively communicating fluid from said first source to said hoist motor and from said second source to said hoist motor; and, control means operatively interconnecting said third and said fourth valve means for movement of said third valve means to fluid directing position over a first range of movement of said control means and for moving said fourth valve means to a fluid directing position and simultaneously therewith for moving said third valve means to a non-fluid communicating position over a second range of movement.

9. The hydraulic circuit of claim 8 comprising hoist drift sensing means responsive to a change in the position of said hoist from a pre-set position to activate control valve actuator means operative for shifting said third valve means for returning said hoist to said pre-set position.

10. The hydraulic circuit of claim 9 wherein said drift sensing means is a valve selectively connectible to said hoist to be actuated thereby.

11. The hydraulic circuit of claim 10 comprising accumulator means for accumulating fluid pressure for operation of said hoist motor when said drift sensing means is operative.

12. The hydraulic circuit of claim 9 comprising accumulator means for accumulating fluid pressure for supplying fluid for said valve actuator means when said drift sensing means is operative.

13. The hydraulic circuit of claim 12 wherein said control means for includes lost motion means connecting said control means to said fourth valve means.

14. A hydraulic pipelayer comprising the combination of a vehicle, an extensible boom pivotally mounted on and extending from one side of said vehicle, a counterweight mounted on and extending from the vehicle on the opposite side from said boom, and a hydraulic manipulating system, said hydraulic system comprising:

a boom lift motor for lifting said boom;

a boom extension motor for extending said boom;

a hoist motor operatively connecting for extending and retracting a cable from the outer end of said boom;

first circuit means including a first source of pressurized fluid for supplying fluid for operation of at least two of said motors for a low speed of operation of said motors;

second circuit means including a second source of pressurized fluid for supplying fluid for at least said two of said motors for high speed operation of said motors;

first and second valve means operative for controlling the direction of said pressurized fluid to selected ones of said motors; and, control means interconnecting at least a pair of valves of said valve means for sequential movement over a first range of movement for directing fluid from one of said sources to one of said motors and thereafter over a second range of movement for directing fluid from the other of said sources to said motor.

15. The hydraulic system of claim 14 wherein said motor is the hoist motor.

16. The hydraulic system of claim 14 wherein said motor is the boom lift motor.

17. The hydraulic system of claim 14 wherein the volume of said first source of fluid is approximately one fourth that of said second source.

18. The hydraulic system of claim 14 wherein said control means operatively interconnects a first pair of valves for directing fluid sequentially from said first and said second sources to said boom lift motor;

said control means operatively interconnects a second pair of valves for directing fluid from said first and said second source to said hoist motor; and, said control means includes lost motion linkage means between said control means and one valve in each of said first and second pairs of valves.

19. The hydraulic system of claim 18 comprising anti-drift means operative for correcting drift of either one of said boom and said hoist motors.

20. The hydraulic system of claim 19 wherein said anti-drift means includes:

fluid responsive actuator means for each of said first and second pairs of valves;

valve means selectively connectible to move in response to movement of either one of said boom and hoist motors from a pre-set position; and, accumulator means operative in combination with said first circuit means for providing pressurized fluid for said actuator means and for operation of said motors.

* * * * *